US007921914B2

(12) United States Patent
Bruins et al.

(10) Patent No.: US 7,921,914 B2
(45) Date of Patent: Apr. 12, 2011

(54) COMBINED THREE-IN-ONE FRACTURING SYSTEM

(75) Inventors: Matt Bruins, Medicine Hat (CA); Brendon Hamilton, Medicine Hat (CA)

(73) Assignee: Hitman Holdings Ltd., Alberta (CA)

( * ) Notice: Subject to any disclaimer, the term of this patent is extended or adjusted under 35 U.S.C. 154(b) by 69 days.

(21) Appl. No.: 12/409,372

(22) Filed: Mar. 23, 2009

(65) Prior Publication Data

US 2009/0308602 A1 Dec. 17, 2009

(51) Int. Cl.
*E21B 43/26* (2006.01)

(52) U.S. Cl. ..... 166/308.1; 166/90.1; 166/177.5

(58) Field of Classification Search ..... 166/308.1, 166/308.2, 90.1, 177.5
See application file for complete search history.

(56) References Cited

U.S. PATENT DOCUMENTS

2009/0050311 A1* 2/2009 Crawford ..... 166/90.1
2009/0151927 A1* 6/2009 Crawford ..... 166/90.1

* cited by examiner

*Primary Examiner* — William P Neuder
(74) *Attorney, Agent, or Firm* — Klarquist Sparkman, LLP

(57) ABSTRACT

A three-in-one fracturing system is provided, which combines on a single trailer that can be pulled by a single tractor, a blending system for blending a fracturing fluid, a fluid pumping system for pumping the fracturing fluid into the well, and a data cabin for monitoring the operation of the blending system and the fluid pumping system.

19 Claims, 5 Drawing Sheets

COMBINED THREE-IN-ONE FRACTURING SYSTEM

RELATED APPLICATION DATA

This application claims priority to Canada Patent Application No. 2,634,861, filed Jun. 11, 2008, which is incorporated herein by reference.

FIELD

This invention relates to hydraulic fracturing systems for the oil and gas industry.

BACKGROUND

Fracturing ("frac") operations for stimulating oil and gas wells to increase production are known in the art. However, the prior art has not recognized that a single, combined trailer system can be provided with all of the equipment and accessories for mixing and pumping fracturing fluid.

Typically three tractor trailer assemblies, for mixing and pumping, are brought to a well to be fractured: one having a data cabin; one having a fluid pumping system; and the other having a blending system.

The above described "multiple" trailer setup has numerous disadvantages. Most obviously, the cost of operating the three separate rigs is high because of personnel, fuel and equipment requirements.

The multiple trailer setup also has an adverse environmental impact due to pollution and surface damage caused by the trailers. Environmentalists and government agencies are increasingly demanding that attention be paid to reducing the footprint of oil and gas field activities.

There are also problems inherent in connecting components from different trailers, by both low and high pressure piping to the well and other components. Assembly and disassembly of multiple connections after every job increases the chances of a problem occurring, which could pose a safety hazard.

SUMMARY

The combined three-in-one fracturing system described herein seeks to overcome the above disadvantages. The combined system of the application provides a single trailer which can be pulled by a single tractor. The combined system is a three-in-one system for use in fracturing operations. The system comprises a data cabin, a fluid pumping system and a blending system mounted together on the single trailer. The trailer is generally equipped with a 24 wheel suspension, which distributes the weight of the combined system so as to minimize the impact of the trailer on roadways and at the well site.

In accordance with one aspect then, there is provided a combined three-in-one fracturing system for treating an oil or gas well, comprising: a single tractor having an engine for moving itself and for pulling a single trailer, said single trailer having mounted thereon: a blending system for blending a fracturing fluid; a fluid pumping system for pumping the fracturing fluid into the well; and a data cabin including equipment for controlling and monitoring the operation of the blending system and the fluid pumping system.

In accordance with another aspect, there is provided a combined three-in-one fracturing system for treating an oil or gas well, comprising: a single trailer, wherein said single trailer has mounted thereon: a blending system for blending a fracturing fluid; a fluid pumping system for pumping the fracturing fluid into the well; and a data cabin including equipment for controlling and monitoring the operation of the blending system and the fluid pumping system.

In accordance with a further aspect, there is provided a method of fracturing an oil or gas well, comprising the steps of: locating the combined three-in-one fracturing system described above near the well, wherein the well site includes a sand bin and a water tank; connecting said blending system to said water tank; providing sand from said sand bin to said blending system; operating said blending system to produce blended fracturing fluid; operating said fluid pumping system to pump said blended fracturing fluid into the well; controlling and monitoring the operation of said fluid pumping system and said blending system from said data cabin.

In operation, the combined system is driven to a well site requiring fracturing. Once at the site, the pumping system and blending system are deployed according to standard procedures known in the art, and controlled and monitored from the data cabin.

The combined system greatly reduces the onsite footprint of fracturing equipment. The number of trailer loads that must be transported to a well site is reduced, thereby minimizing surface damage. Furthermore, by reducing the number of engines required to both transport equipment and perform jobs, the combined system reduces total fuel consumption and engine emissions on a per well basis.

The combined system also requires less assembly and disassembly for each job than does a multiple trailer equivalent, thereby increasing efficiency and safety.

Accordingly, there is described herein embodiments of the applicant's combined system.

It is to be understood that other aspects of the present combined three-in-one fracturing system will become readily apparent to those skilled in the art from the following detailed description, wherein various embodiments are shown and described by way of illustration. As will be realized, the combined three-in-one fracturing system is capable of other and different embodiments and its several details are capable of modification in various other respects, all without departing from the spirit and scope of the combined three-in-one fracturing system described. Accordingly, the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the applicant's combined three-in-one fracturing system are illustrated by way of example, and not by way of limitation, in detail in the figures, wherein.

DETAILED DESCRIPTION

Figure 1:
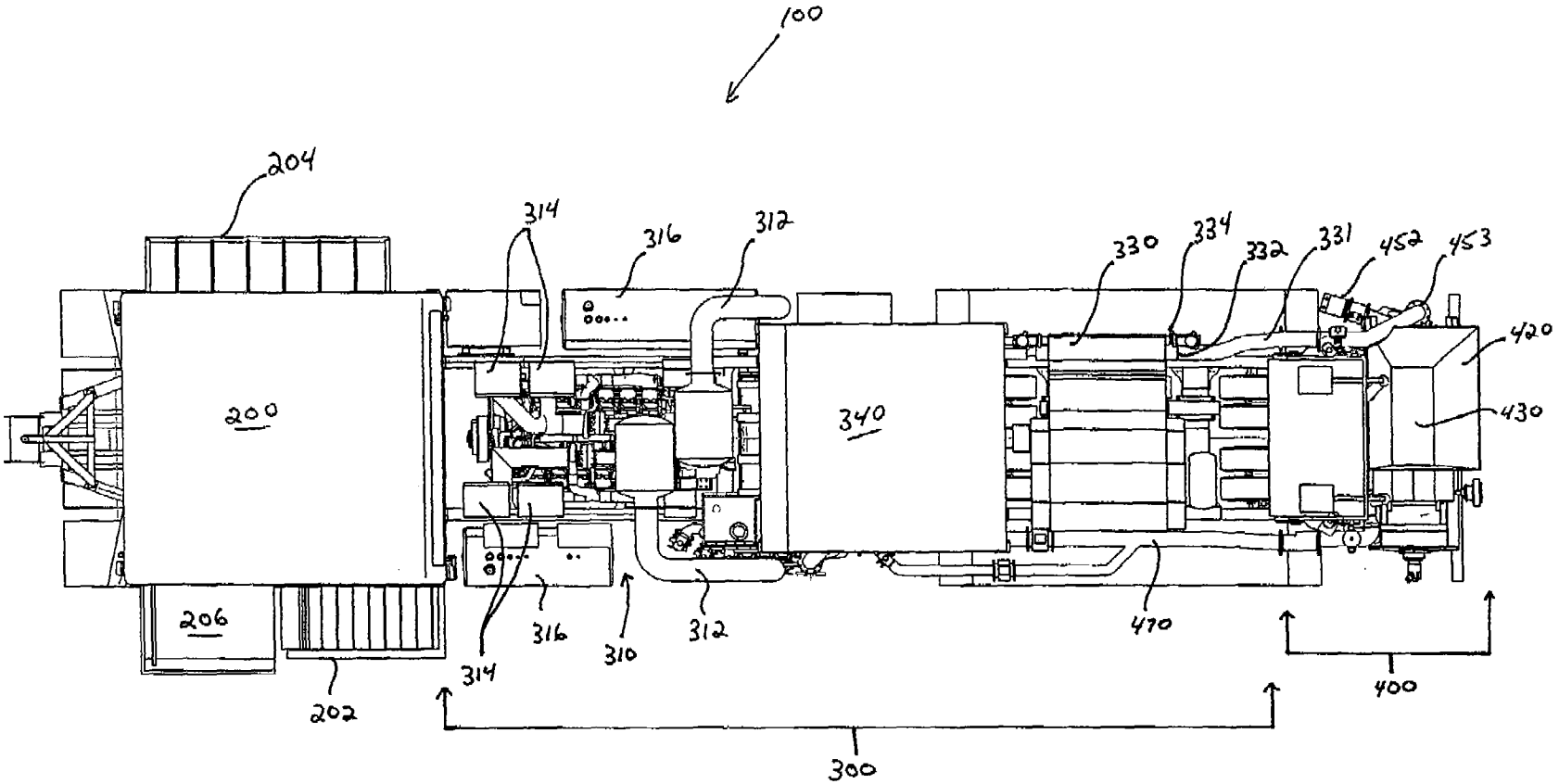
FIG. 1 shows a top-down view of one aspect of the applicant's combined three-in-one fracturing system.
Figure 2:
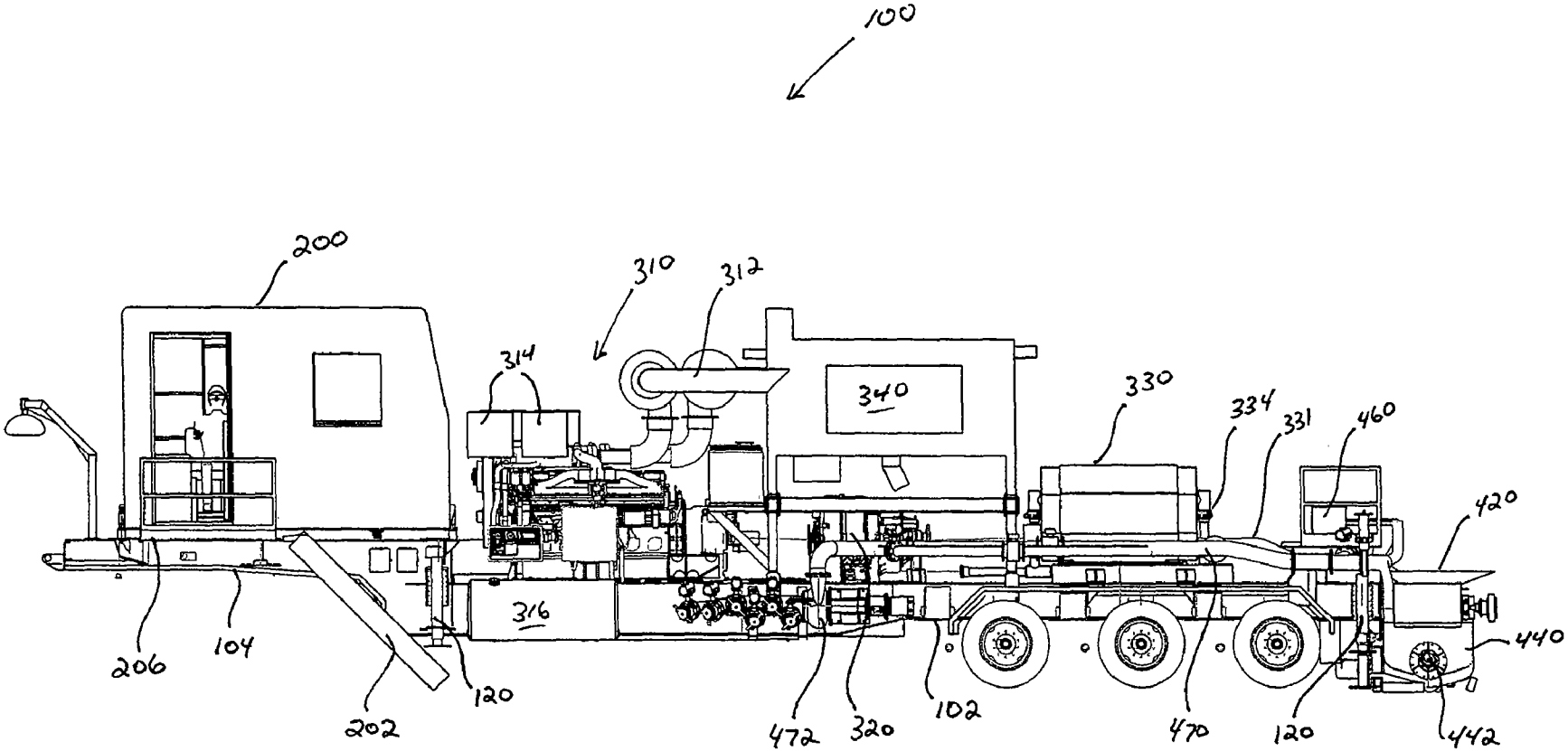
FIG. 2 shows a left-side view of the combined three-in-one fracturing system shown in FIG. 1.

The applicant's combined three-in-one fracturing system is herein described in detail. FIGS. 1 and 2 show an embodiment of the combined three-in-one fracturing system 100. The combined system 100 generally comprises a trailer 102 with a data cabin 200, a fluid pumping system 300 and a blending system 400.

The trailer 102 comprises a 24-wheel suspension such as a tridem 24-wheel suspension, which allows the trailer's ground pressure load to be distributed over a large area. Generally, the combined system of the present invention has a width of around 11 feet, while conventional trucks have a width of 8½ feet.

The trailer 102 may be connected to a tractor (not shown), in a manner that is well known in the art, to haul the combined three-in-one fracturing system 100 to different job sites. The tractor's engine may also provide power for hydraulic components of the combined system 100. In one embodiment, as is known in the art, a power splitter box, for example an Omsi™ box is put into the main drive line of the tractor and used to drive hydraulic pumps, centrifugal pumps and auger and belt motors. If additional power is needed, the tractor's power take-off (PTO) may be used.

The following description of the data cabin, the blending system, and the fluid pumping system are provided by way of example only, unless otherwise specified.

Data Cabin

Referring again to FIGS. 1 and 2, a data cabin 200 is mounted on a gooseneck 104 of the trailer 102. The data cabin preferably comprises a removable staircase 202 and platform 206, which facilitate access to the data cabin. The staircase 202 and platform 206 can be unlocked and stored under the data cabin to reduce the width of the combined system 100 when the trailer 102 is moved.

The data cabin 200 may have a sliding portion 204 on one side. The sliding portion can be moved between a nested position and an extended position. In the nested position, the sliding portion 204 is secured substantially inside the data cabin. This reduces the width of the data cabin, which facilitates movement of the trailer 102. In the extended position (as shown in FIG. 1), the sliding portion 204 is extended laterally away from the side of the data cabin, thereby increasing the square footage of floor space inside the data cabin. The data cabin generally houses equipment, known in the art, for controlling and monitoring a well fracturing operation, for example, a programmable logic controller (PLC), electric controls for the fluid pumping system 300 and the blender system 400, storage for job data and screens to monitor the operation in real time.

Advantageously, having data cabin 200 provided with blending system 400 and fluid pumping system 300 on a single truck allows for a fully dedicated control system, specifically tailored for fracturing jobs. Other advantages, such as reduced set-up time, reduced costs, and increased efficiency are also made possible.

Blending System

Figure 3:
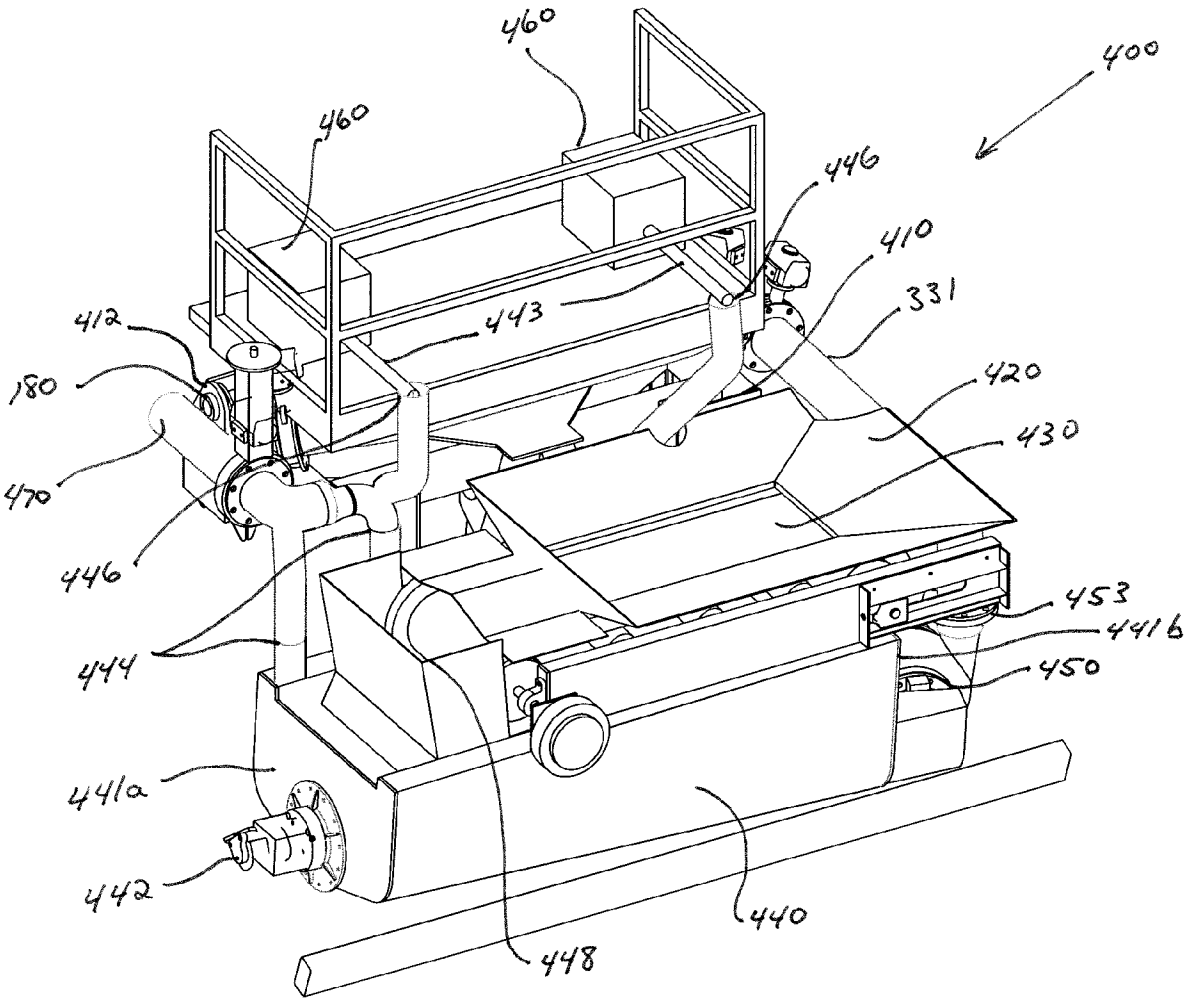
FIG. 3 shows a perspective, view of one embodiment of the blending system of the combined three-in-one fracturing system.
Figure 4:
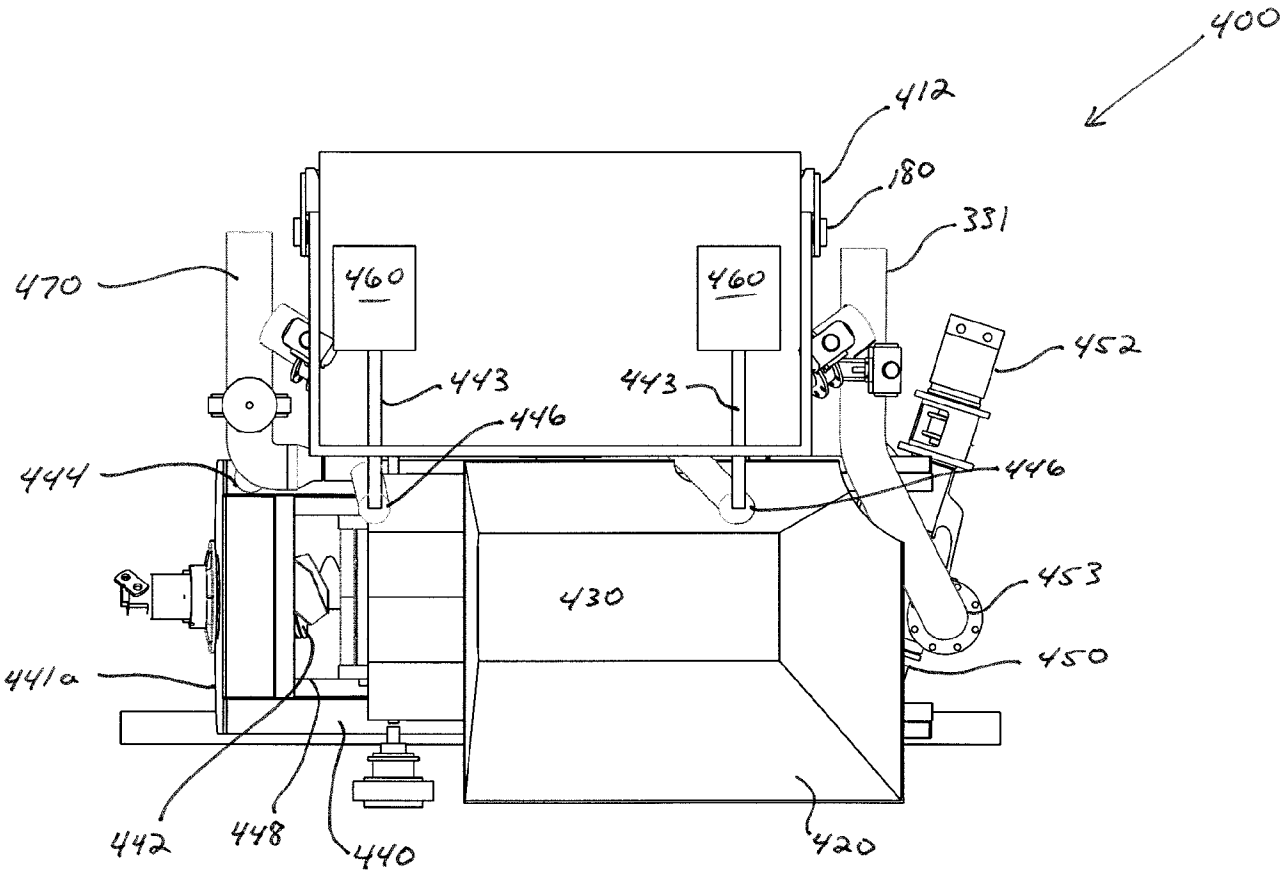
FIG. 4 is a top plan view of the blending system shown in FIG. 3.
Figure 5:
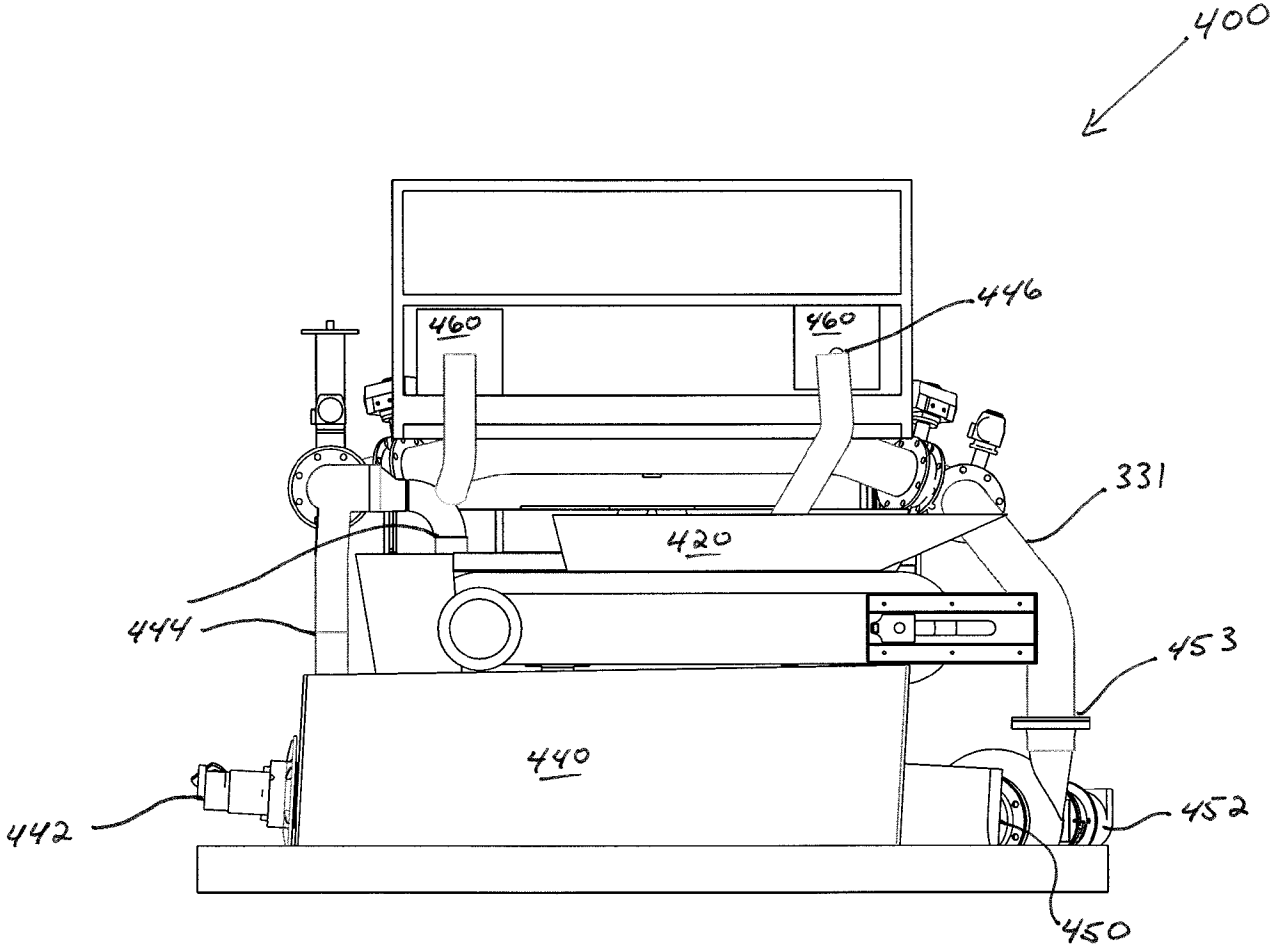
FIG. 5 is a rear elevation view of the blending system shown in FIG. 3.

An embodiment of the blending system 400, which may be used in implementing the applicant's combined three-in-one fracturing system is shown in FIGS. 3, 4 and 5. FIG. 3 is a perspective view of the blending system, while FIG. 4 is a top plan view and FIG. 5 is a real elevation view.

Blending system 400 is pivotably mounted to the trailer 102 adjacent to the fluid pumping system 300, via pivot couplings 412. The blending system may be moved 90 degrees between a raised position for transport and a lowered position (as shown in FIGS. 1 and 2) for fracturing operations, as is described in greater detail below.

The blending system 400 generally comprises a base structure 410, on which there are mounted the following elements: a hopper 420; a conveyer belt 430; a mixing tub 440; and chemical pumps 460. Hopper 420 is mounted on top of mixing tub 440. Preferably, the blending system 400 utilizes axial (horizontal) flow mixing, which allows the mixer to run at low rpm thereby extending the mixer's operating life. One of the advantages of axial mixing is that it will help to reduce the entrapment of gases in the mixture.

As mentioned, the base structure 410 is pivotably mounted to the trailer 102 at pivot couplings 412. A pin 180 is inserted through holes in pivot couplings 412 to secure the base structure in the raised position. The mixing tub 440 is mounted to the base structure 410, and provides for components of a fracturing fluid to be blended together. A mixing auger 442 extends through the length of the mixing tub 440, proximate to the bottom of the tub, from a first end 441*a* of the mixing tub to a second end 441*b*. As the auger 442 is rotated, the contents of the mixing tub are blended and carried from the first end of the tub to a second end of the tub, and out through an outlet 450.

The mixing tub 440 has several inlets formed therein for injecting fracturing fluid components into the mixing tub: water inlets 444, chemical inlet 446, and sand inlet 448. In other embodiments, there may be other injection points for chemicals depending on the type of chemical and hydration time needed for a particular fracturing operation. A water pipe 470 (See FIGS. 1 and 2) carries water to the water inlets. A centrifugal pump 472 is actuatable to pump water through the water pipe 470.

As mentioned above, the conveyer belt 430 and the hopper 420 are mounted above the mixing tub 440. The hopper 420 is for receiving sand or other materials to be blended into the fracturing fluid. The hopper 420 is open at its bottom. Sand and other materials poured into the top of the hopper are deposited on the conveyer belt. The conveyer belt is operable to convey the sand and materials to sand inlet 448 in the top of the mixing tub 440. The speed at which the conveyer belt rotates may be controlled so that sand is introduced to the mixing tub in predetermined increments.

Dry chemical additives are provided by chemical pumps 460, through chemical pump outlets 443, which in the embodiment shown are conveniently positioned directly above chemical inlet 446. From chemical inlet 446, dry chemical additives are added to the mixing tub 440 where they mix with other components of the fracturing fluid.

The second end 441*b* of the mixing tub 440 has an outlet 450 formed therein. The outlet 450 is connected to another centrifugal pump 452 that pumps blended fracturing fluid from the mixing tub 440 to a high pressure fluid pump 330 (see FIGS. 1 and 2) via centrifugal pump outlet 453. The blended fluid then travels from centrifugal pump outlet 453 to a fluid inlet 332 of high pressure fluid pump 330 through piping 331.

Fluid Pumping System

The fluid pumping system 300 is mounted on the trailer 102 between the data cabin 200 and the blending system 400. The fluid pumping system generally comprises an internal combustion motor 310, for example, a Cummins™ 2250 HP motor, having exhausts 312 and air filters 314. Fuel for the motor 310 is stored in fuel tanks 316. Power from the motor 310 is transferred through a twin disc transmission 320 to power the high pressure fluid pump 330, for example, a QWS 2500 Quintiplex SPM fluid pump known in the art. The high pressure fluid pump 330 comprises a fluid inlet 332 for receiving fluid from the blending system 400 and a fluid outlet 334. An aluminum radiator 340 is mounted above the transmission 320. The radiator 340 is adapted to provide cooling for the components of the fluid pumping system 300.

The high pressure fluid pump 330, powered by engine 310, receives blended fracturing fluids from the blending system via inlet 332, and provides high pressure fluids for the well site fracturing operation through outlet 334.

Operation

The trailer 102 is moved from location to location, for example well sites, by a tractor (not shown) having either a gasoline engine or a diesel engine. The tractor is, for example, a tri-drive truck known in the art. The tractor has an assembly, known in the art, which is used to connect the tractor to the trailer 102.

A description of the operation of the combined system 100 follows. The tractor pulls the combined system 100 to a well site and backs it up to sand bins already located at the site. The combined system is then parked and leveled using four outriggers 120 positioned at the four corners of the trailer 102. Once the combined system is level, the pin 180 that secures the blending system 400 in an upright position is pulled, and the blending system is hydraulically lowered to the ground, thereby positioned for receiving sand from the sand bins.

The combined system 100 is now in position for performing a fracturing operation. The stairs 202 and platform 206 are removed from storage beneath the data cabin 200, and are locked in place adjacent the data cabin as shown in FIG. 1, thereby facilitating access to the data cabin. The water pipe 470 is attached to a water tank (not shown) which is parked adjacent to the combined system. High pressure iron joints are used to connect the high pressure fluid pump 330 of the fluid pumping system 300 to tubing (not shown) which extends down a well bore to be treated with fracturing fluid.

When the fracturing operation commences, water for the fracturing fluid is pumped from the water tank through the water pipe 470 to the water inlets of the mixing tub by the centrifugal pump 472. Sand for the fracturing fluid is poured from the sand bins into the hopper 420 and onto the conveyor belt 430. The conveyor belt 430 controls the rate at which sand is added to the mixing tub. Chemicals, for example, dry chemical additives, are injected into the mixing tub from the chemical pumps 460 via chemical inlet 446. Once in the mixing tub, the sand, chemicals and water are all mixed and passed to the centrifugal pump 452 which delivers the fracturing fluid mixture to the high pressure fluid pump 330. The high pressure fluid pump operates to pump the fracturing fluid down the well bore.

The previous detailed description is provided to enable any person skilled in the art to make or use the applicant's combined three-in-one fracturing system. Various modifications to the embodiments described will be readily apparent to those skilled in the art, and the generic principles defined herein may be applied to other embodiments without departing from the spirit or scope of the combined three-in-one fracturing system described herein. Thus, the present combined three-in-one fracturing system is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A combined three-in-one fracturing system for treating an oil or gas well, comprising:

a single trailer, wherein said single trailer has mounted thereon:

a blending system for blending a fracturing fluid, said blending system being movable between a raised position for transport and a lowered position for treating the well;

a fluid pumping system for pumping the fracturing fluid into the well; and a data cabin including equipment for controlling and monitoring the operation of the blending system and the fluid pumping system.

2. The combined three-in-one fracturing system according to claim 1, including a single tractor having an engine for moving itself and for pulling said single trailer.

3. A method of fracturing an oil or gas well, comprising the steps of:

locating the combined three-in-one fracturing system of claim 2 near the well, wherein the well site includes a sand bin and a water tank;

connecting said blending system to said water tank;

providing sand from said sand bin to said blending system;

operating said blending system to produce blended fracturing fluid;

operating said fluid pumping system to pump said blended fracturing fluid into the well;

controlling and monitoring the operation of said fluid pumping system and said blending system from said data cabin.

4. The combined three-in-one fracturing system according to claim 1, wherein said blending system has an outlet and said fluid pumping system has an inlet, and wherein said outlet of said blending system is connected to said inlet of said fluid pumping system.

5. The combined three-in-one fracturing system according to claim 1, wherein said single trailer comprises a 24 wheel suspension.

6. The combined three-in-one fracturing system according to claim 5, wherein said single trailer has a width of about 11 feet.

7. The combined three-in-one fracturing system according to claim 1, wherein said blending system is located at a rear end of said single trailer.

8. The combined three-in-one fracturing system according to claim 1, wherein said data cabin is located at a front end of said single trailer.

9. The combined three-in-one fracturing system according to claim 8, wherein said single trailer comprises a goose neck at said front end of said single trailer, and wherein said data cabin is mounted on said goose neck.

10. The combined three-in-one fracturing system according to claim 1, wherein said data cabin includes an extendable platform that may be moved from a nested position inside the data cabin, to an extended position outside the data cabin to thereby extend the width of the data cabin.

11. The combined three-in-one fracturing system according to claim 1, wherein said fluid pumping system comprises an internal combustion engine, and a high pressure fluid pump, wherein said high pressure fluid pump is powered by said internal combustion engine.

12. The combined three-in-one fracturing system according to claim 1, wherein the blending system is a horizontal blending system.

13. A method of fracturing an oil or gas well, comprising the steps of:

locating the combined three-in-one fracturing system of claim 1 near the well, wherein the well site includes a sand bin and a water tank;

connecting said blending system to said water tank;

providing sand from said sand bin to said blending system;

operating said blending system to produce blended fracturing fluid;

operating said fluid pumping system to pump said blended fracturing fluid into the well;

controlling and monitoring the operation of said fluid pumping system and said blending system from said data cabin.

14. A combined three-in-one fracturing system for treating an oil or gas well, comprising:

a single trailer, wherein said single trailer has mounted thereon:

a blending system for blending a fracturing fluid;

a fluid pumping system for pumping the fracturing fluid into the well;

a data cabin including equipment for controlling and monitoring the operation of the blending system and the fluid pumping system, said data cabin located at a front end of said single trailer; and a goose neck at said front end of said single trailer, wherein said data cabin is mounted on said goose neck.

15. A method of fracturing an oil or gas well, comprising the steps of:

locating the combined three-in-one fracturing system of claim 14 near the well, wherein the well site includes a sand bin and a water tank;

connecting said blending system to said water tank;

providing sand from said sand bin to said blending system;

operating said blending system to produce blended fracturing fluid;

operating said fluid pumping system to pump said blended fracturing fluid into the well;

controlling and monitoring the operation of said fluid pumping system and said blending system from said data cabin.

16. A combined three-in-one fracturing system for treating an oil or gas well, comprising:

a single trailer, wherein said single trailer has mounted thereon:

a blending system for blending a fracturing fluid;

a fluid pumping system for pumping the fracturing fluid into the well; and a data cabin including equipment for controlling and monitoring the operation of the blending system and the fluid pumping system, the data cabin including an extendable platform that may be moved from a nested position inside the data cabin, to an extended position outside the data cabin to thereby extend the width of the data cabin.

17. A method of fracturing an oil or gas well, comprising the steps of:

locating the combined three-in-one fracturing system of claim 16 near the well, wherein the well site includes a sand bin and a water tank;

connecting said blending system to said water tank;

providing sand from said sand bin to said blending system;

operating said blending system to produce blended fracturing fluid;

operating said fluid pumping system to pump said blended fracturing fluid into the well;

controlling and monitoring the operation of said fluid pumping system and said blending system from said data cabin.

18. A combined three-in-one fracturing system for treating an oil or gas well, comprising:

a single trailer, wherein said single trailer has mounted thereon:

a blending system for blending a fracturing fluid;

a fluid pumping system for pumping the fracturing fluid into the well, the fluid pumping system including an internal combustion engine, and a high pressure fluid pump, wherein the high pressure fluid pump is powered by the internal combustion engine; and a data cabin including equipment for controlling and monitoring the operation of the blending system and the fluid pumping system.

19. A method of fracturing an oil or gas well, comprising the steps of:

locating the combined three-in-one fracturing system of claim 18 near the well, wherein the well site includes a sand bin and a water tank;

connecting said blending system to said water tank;

providing sand from said sand bin to said blending system;

operating said blending system to produce blended fracturing fluid;

operating said fluid pumping system to pump said blended fracturing fluid into the well;

controlling and monitoring the operation of said fluid pumping system and said blending system from said data cabin.

* * * * *